US005888376A

United States Patent [19]

Wittenbrink et al.

[11] Patent Number: 5,888,376

[45] Date of Patent: Mar. 30, 1999

[54] CONVERSION OF FISCHER-TROPSCH LIGHT OIL TO JET FUEL BY COUNTERCURRENT PROCESSING

[75] Inventors: Robert J. Wittenbrink, Baton Rouge, La.; Stephen Mark Davis, Houston; Larry L. Iaccino, Friendswood, both of Tex.

[73] Assignee: Exxon Research and Engineering Co., Florham Park, N.J.

[21] Appl. No.: 868,396

[22] Filed: Jun. 3, 1997

Related U.S. Application Data

[60] Provisional application No. 60/025,209 filed Aug. 23, 1996.

[51] Int. Cl.[6] ..... C10G 65/10

[52] U.S. Cl. ..... 208/59; 208/57; 208/58; 208/89; 208/46; 208/27; 208/28; 208/60; 208/62

[58] Field of Search ..... 208/57, 58, 59, 208/89

[56] References Cited

U.S. PATENT DOCUMENTS

| | | | |
|---|---|---|---|
| 3,147,210 | 9/1964 | Hass et al. | 208/210 |
| 3,767,562 | 10/1973 | Sze et al. | 208/57 |
| 3,775,291 | 11/1973 | Sze et al. | 208/57 |
| 4,599,162 | 7/1986 | Ven | 208/59 |
| 5,183,556 | 2/1993 | Reilly et al. | 208/57 |
| 5,378,348 | 1/1995 | Davis et al. | 208/27 |
| 5,522,983 | 6/1996 | Cash et al. | 208/59 |

*Primary Examiner*—Helane Myers
*Attorney, Agent, or Firm*—Henry E. Naylor

[57] ABSTRACT

A process for converting a Fischer-Tropsch light oil stream to jet fuel by reacting said stream with a hydroisomerization catalyst in a reaction zone where the stream flows counter-current to upflowing hydrogen-containing treat gas.

15 Claims, No Drawings

CONVERSION OF FISCHER-TROPSCH LIGHT OIL TO JET FUEL BY COUNTERCURRENT PROCESSING

This application claims benefit of provisional application 60/025,209, filed Aug. 23, 1996.

FIELD OF THE INVENTION

The present invention relates to a process for converting a Fischer-Tropsch light oil stream to jet fuel by reacting said stream with a hydroisomerization catalyst in a reaction zone where the stream flows countercurrent to upflowing hydrogen-containing treat gas.

Background of the Invention

It is known to produce products, such as distillate fuels, including jet fuels, and lubes from Fischer-Tropsch reaction products by catalytic hydrocracking, hydroisomerization, catalytic dewaxing, or a combination thereof. In Fischer-Tropsch process units a synthesis gas is reacted over a Group VI or VIII metal catalyst, then mildly hydroisomerized and/or mildly hydrocracked over a suitable catalyst to produce a distillate fuel, or refinery feedstock useful for conversion to a distillate fuel. In recently issued U.S. Pat. No. 5,378,348, good yields of distillate fuels with excellent cold flow properties are produced from waxy Fischer-Tropsch products via an improved fixed bed process wherein the waxy Fischer-Tropsch product is separated into 260° C. minus and 260° C. plus fractions and separately hydroisomerized to make middle distillates. The 260° C. minus fraction, e.g., 160° to 260° C. fraction, is hydrotreated in a first step at mild conditions over a suitable catalyst to remove heteroatoms, and hydroisomerized is a second step over a fixed bed of a Group VIII noble metal catalyst, suitably a platinum or palladium catalyst, to yield jet fuel and a light naphtha by-product. The heavier 260° C. plus fraction, on the other hand, is directly hydrocracked to produce a 160° to 370° C. fraction which is useful as a diesel or jet fuel, or as a blending component for diesel or jet fuel. While this process demonstrates the feasibility of producing distillates with improved cold flow properties from waxy hydrocarbons, there remains a need to provide further improvements in the hydroisomerization.

The Fischer-Tropsch reaction product will normally be fractionated into various streams, typically three streams. One stream is a $C_5$+ to 260° C. stream, which is known as a Fischer-Tropsch light oil stream. The other streams are a 260° C. to 370° C. stream and a 370° C.+ stream. The 260° C.+ streams are typically wax streams and must be subjected to hydrodewaxing, especially if they are to be used in lubricants. The light oil stream is suitable for use as jet fuels, but the high levels of paraffins in Fischer-Tropsch products provide notoriously poor cold flow properties making the products difficult or impossible to use where cold flow properties are vital. Cold flow properties can be improved by increasing the branching of the molecules. This is typically done by hydroisomerization processes performed in conventional fixed bed reactors utilizing bifunctional catalysts consisting of a dehydrogenation component on an acidic support. Since bifunctional catalysts are particularly sensitive to heteroatoms, such as oxygenates, the feed must be hydrotreated prior to hydroisomerization if an undesirable level of heteroatoms are present.

Heteroatoms such as sulfur, nitrogen, and oxygen are known catalyst poisons and their removal from petroleum feedstocks is often referred to as hydrotreating. Typically, catalytic hydroprocessing, which includes hydrotreating, hydroisomerization, and hydrodewaxing, of liquid-phase petroleum feedstocks is carried out in co-current reactors in which both a preheated liquid feedstock and a hydrogen-containing treat gas are introduced to the reactor at a point, or points, above one or more fixed beds of hydroprocessing catalyst. The liquid feedstock, any vaporized hydrocarbons, and hydrogen-containing treat gas, all flow in a downward direction through the catalyst bed(s). The resulting combined vapor phase and liquid phase effluents are normally separated in a series of one or more separator vessels, or drums, downstream of the reactor. Dissolved gases are normally removed from the recovered liquid stream by gas or steam stripping in yet another downstream vessel or vessels, or in a fractionator.

Conventional co-current catalytic hydroprocessing has met with a great deal of commercial success; however, it has limitations. For example, because of hydrogen consumption and treat gas dilution by light reaction products, hydrogen partial pressure decreases between the reactor inlet and outlet. At the same time, any reactions for removing heteroatoms, such as hydrodesulfurization and hydrodenitrogenation that take place results in increased concentrations of $H_2S$, $NH_3$, or oxygenates. These are all known to inhibit the activity and performance of hydroprocessing catalysts through competitive adsorption on the catalyst. Thus, the downstream portion of catalyst in a conventional co-current reactor is often limited in reactivity because of the simultaneous occurrence of multiple negative effects, such as low $H_2$ partial pressure and the presence of high concentrations of heteroatom components. Further, liquid phase concentrations of the targeted hydrocarbon reactants are also the lowest at the downstream part of the catalyst bed. Also, because kinetic and thermodynamic limitations can be severe, particularly at deep levels of heteroatom removal, higher reaction temperatures, higher treat gas rates, higher reactor pressures, and often higher catalyst volumes are required. Multistage reactor systems with stripping of heteroatom-containing species between reactors and additional injection of fresh hydrogen-containing treat gas are often employed, but they have the disadvantage of being equipment intensive processes.

Another type of hydroprocessing is countercurrent hydroprocessing which has the potential of overcoming many of these limitations, but is presently of very limited commercial use today. U.S. Pat. No. 3,147,210 discloses a two stage process for the hydrofining-hydrogenation of high-boiling aromatic hydrocarbons. The feedstock is first subjected to catalytic hydrofining, preferably in co-current flow with hydrogen, then subjected to hydrogenation over a sulfur-sensitive noble metal hydrogenation catalyst countercurrent to the flow of a hydrogen-containing treat gas. U.S. Pat. Nos. 3,767,562 and 3,775,291 disclose a countercurrent process for producing jet fuels, whereas the jet fuel is first hydrodesulfurized in a co-current mode prior to two stage countercurrent hydrogenation. U.S. Pat. No. 5,183,556 also discloses a two stage co-current/countercurrent process for hydrofining and hydrogenating aromatics in a diesel fuel stream.

While the state of the art relating to producing distillate fuels and lubricant products from Fischer-Tropsch waxes has advanced rapidly over the past decade, there is still a substantial need in the for ever improved efficient processes for achieving same.

SUMMARY OF THE INVENTION

In accordance with the present invention there is provided a process for converting a predominantly paraffinic stream boiling in the range of about 40° C. to about 260° C. to jet fuel, which process comprises:

reacting said stream in at least one reaction zone wherein the product stream flows countercurrent to upflowing hydrogen-containing treat gas in the presence of a hydroisomerization catalysts under hydroisomerization conditions.

In a preferred embodiment of the present invention, there is provided at least one co-current hydrotreating zone followed by at least one countercurrent hydroisomerization zone.

In another preferred embodiment of the present invention, the predominantly paraffinic stream is a Fischer-Tropsch stream.

DETAILED DESCRIPTION OF THE INVENTION

Feedstocks which are suitable for use in the practice of the present invention are predominantly paraffinic feedstocks boiling in the range of about 40° C. to about 260° C. By predominantly paraffinic we mean that the at least about 70 wt. %, preferably at least about 80 wt. %, and more preferably at least about 90 wt. % of the feed will be paraffinic, based on the total weight of the feed. The most preferred feeds are the so-called "light oil" products from a Fischer-Tropsch process wherein a synthesis gas mixture of carbon monoxide and hydrogen are converted to predominantly aliphatic straight-chain hydrocarbons and oxygenated derivatives The stream will be subjected to hydroisomerization in a countercurrent reaction zone wherein liquid feed flows countercurrent to upflowing hydrogen-containing treat gas. If an undesirable amount of heteroatoms are present, the feed can first be subjected to hydrotreating, either in the same reactor or in a separate reactor to remove a substantial portion of the heteroatoms.

Hydroisomerization is typically used to produce distillate fuels with good cold flow properties in good yield from $C_5$+ streams by contacting and reacting the stream with a hydrogen-containing gas over a small particle size hydroisomerization catalyst dispersed, or slurried, in a paraffinic or waxy liquid medium. The hydroisomerization reaction is conducted at conditions which produce $C_5$ to 260° C. distillate products including jet fuel, diesel fuel, lubes, and high quality blending components for the production of these materials. In general, the hydroisomerization reaction is conducted at temperatures ranging from about 200° C. to about 450° C., preferably from about 260° C. to about 370° C., and at pressures ranging generally from about 100 psig to about 1500 psig, preferably from about 300 psig to about 1000 psig. The reaction is generally conducted at hydrogen treat gas rates ranging from about 1000 SCFB to about 10,000 SCFB, preferably from about 2000 SCFB to about 5000 SCFB (standard cubic feet per barrel). Space velocities range generally from about 0.5 LHSV to about 20 LHSV, preferably from about 2 LHSV to about 10 LHSV (liquid hourly space velocity).

Hydroisomerization catalysts suitable for use herein will typically be bifunctional. That is, containing an active metal hydrogenation component or components, and a support component, which will preferably be acidic. The active metal component is preferably one or more metals selected from Groups IB, VIB, and VIII of the Periodic Table of the Elements (Sargent-Welch Scientific Company, Copyright 1968) in an amount sufficient to be catalytically active for hydroisomerization. Generally, metal concentrations range from about 0.05 wt. % to about 20 wt. % based on the total weight of the catalyst, preferably from about 0.1 wt. % to about 10 wt. %. Exemplary of such metals are such non-noble Group VIII metals as nickel and cobalt, or mixtures of these metals with each other or with other metals, such as copper, a Group IB metal, or molybdenum, a Group VIB metal. Palladium is exemplary of a suitable Group VIII noble metal. The metal, or metals, is incorporated with the support component of the catalyst by known methods, e.g., by impregnation of the support with a solution of a suitable salt or acid of the metal, or metals, drying and calcination.

The catalyst support is preferably selected from constituted of metal oxide, more preferably wherein at least one component is an acidic oxide which is active for producing olefin cracking and hydroisomerization reactions. Preferred oxides include silica, silica-alumina, clays, e.g., pillared clays, magnesia, titania, zirconia, halides, e.g., chlorided alumina, and the like. The catalyst support is more preferably comprised of silica and alumina, a particularly preferred support being constituted of up to about 25 wt. % silica, preferably from about 2 wt. % to about 35 wt. % silica, and having the following pore structural characteristics:

| Pore Radius, Å | Pore Volume |
|---|---|
| 0–300 | >0.03 ml/g |
| 100–75,000 | <0.35 ml/g |
| 0–30 | <25% of the vol. of the pores with 0–300 Å radius |
| 100–300 | <40% of the vol. of the pores with 0–300 Å radium |

The base silica and alumina materials can be, e.g., soluble silica containing compounds such as alkali metal silicates (preferably where $Na_2O:SiO_2$=1:2 to 1:4), tetraalkoxy silane, orthosilic acid ester, etc.; sulfates, nitrates, or chlorides of aluminum alkali metal aluminates; or inorganic or organic salts of alkoxides or the like. When precipitating the hydrates of silica or alumina from a solution of such starting materials, a suitable acid or base is added and the pH is set within a range of about 6.0 to 11.0. Precipitation and aging are carried out, with heating, by adding an acid or base under reflux to prevent evaporation of the treating liquid and charge of pH. The remainder of the support producing process is the same as those commonly employed, including filtering, drying and calcination of the support material. The support may also contain small amounts, e.g., 1–30 wt. % of materials such as magnesia, titania, zirconia, hafnia, and the like.

Support materials and their preparations are described more fully in U.S. Pat. No. 3,843,509 which is incorporated wherein by reference. The support materials generally have a surface area from about 180–400 $m^2/g$, preferably from about 230–375 $m^2/g$, a pore volume generally from about 0.3 to 1.0 ml/g, preferably from about 0.5 to 0.95 ml/g, a bulk density from about 0.5 to 1 g/ml, and a side crushing strength of about 0.8 to 3.5 kg/mm.

As previously mentioned, the most preferred feedstocks of the present invention are Fischer-Tropsch light oil streams which are subjected to countercurrent hydroprocessing in at least one catalyst bed, or reaction zone, wherein feedstock flows countercurrent to upflowing hydrogen-containing treat gas. Typically, the hydroprocessing unit used in the practice of the present invention will be comprised of one or more reaction zones wherein each reaction zone contains a suitable catalyst for the intended reaction and wherein each reaction zone is immediately preceded and followed by a non-reaction zone where products can be removed and/or feed or treat gas introduced. The non-reaction zone will be an empty (with respect to catalyst) horizontal cross section of the reaction vessel of suitable height.

If the feedstock contains unacceptably high levels of heteroatoms, such as sulfur, nitrogen, or oxygen, it can first be subjected to hydrotreating. In such cases, it is preferred that the first reaction zone be one in which the liquid feed stream flows co-current with a stream of hydrogen-containing treat gas through a fixed-bed of suitable hydrotreating catalyst. The term "hydrotreating" as used herein refers to processes wherein a hydrogen-containing treat gas is used in the presence of a catalyst which is primarily active for the removal of heteroatoms, including some metals removal, with some hydrogenation activity. When the feedstock is a Fischer-Tropsch reaction product stream, the most troublesome heteroatom which may need to be removed is oxygen. The feed may have been previously hydrotreated in an upstream operation or hydrotreating may not be required if the feed stream already contains a low level of heteroatoms. The most troublesome heteroatom species in Fischer-Tropsch reaction product streams are the oxygenates.

Suitable hydrotreating catalysts for use in the present invention are any conventional hydrotreating catalyst and includes those which are comprised of at least one Group VIII metal, preferably Fe, Co and Ni, more preferably Co and/or Ni, and most preferably Ni; and at least one Group VI metal, preferably Mo and W, more preferably Mo, on a high surface area support material, preferably alumina. Other suitable hydrotreating catalysts include zeolitic catalysts, as well as noble metal catalysts where the noble metal is selected from Pd and Pt. It is within the scope of the present invention that more than one type of hydrotreating catalyst be used in the same bed. The Group VIII metal is typically present in an amount ranging from about 2 to 20 wt. %, preferably from about 4 to 12%. The Group VI metal will typically be present in an amount ranging from about 5 to 50 wt. %, preferably from about 10 to 40 wt. %, and more preferably from about 20 to 30 wt. %. All metals weight percents are on support. By "on support" we mean that the percents are based on the weight of the support. For example, if the support were to weigh 100 g. then 20 wt. % Group VIII metal would mean that 20 g. of Group VIII metal was on the support. Typical hydroprocessing temperatures will be from about 100° C. to about 450° C. at pressures from about 50 psig to about 2,000 psig, or higher. If the feedstock contains relatively low levels of heteroatoms, then the co-current hydrotreating step can be eliminated and the feedstock can be passed directly to the hydroisomerization zone.

At least one of the reaction zones downstream of an initial co-current hydrotreating reaction zone will be run in countercurrent mode. That is, the liquid hydrocarbon stream will flow downward and a hydrogen-containing gas will flow upward.

It will be understood that the treat-gas need not be pure hydrogen, but can be any suitable hydrogen-containing treat-gas. It is preferred that the countercurrent flowing hydrogen treat-rich gas be cold make-up hydrogen-containing treat gas, preferably hydrogen. The countercurrent contacting of the liquid effluent with cold hydrogen-containing treat gas serves to effect a high hydrogen partial pressure and a cooler operating temperature, both of which are favorable for shifting chemical equilibrium towards saturated compounds. The liquid phase will typically be a mixture of the higher boiling components of the fresh feed. The vapor phase will typically be a mixture of hydrogen, heteroatom impurities, and vaporized liquid products of a composition consisting of light reaction products and the lower boiling components in the fresh feed. The vapor phase in the catalyst bed of the downstream reaction zone will be swept upward with the upflowing hydrogen-containing treat-gas and collected, fractionated, or passed along for further processing. It is preferred that the vapor phase effluent be removed from the non-reaction zone immediate upstream (relative to the flow of liquid effluent) of the countercurrent reaction zone. If the vapor phase effluent still contains an undesirable level of heteroatoms, it can be passed to a vapor phase reaction zone containing additional hydrotreating catalyst and subjected to suitable hydrotreating conditions for further removal of the heteroatoms. It is to be understood that all reaction zones can either be in the same vessel separated by non-reaction zones, or any can be in separate vessels. The non-reaction zones in the later case will typically be the transfer lines leading from one vessel to another. It is also within the scope of the present invention that a feedstock which already contains adequately low levels of heteroatoms fed directly into a countercurrent hydroprocessing reaction zone. If a preprocessing step is performed to reduce the level of heteroatoms, the vapor and liquid are disengaged and the liquid effluent directed to the top of a countercurrent reactor. The vapor from the preprocessing step can be processed separately or combined with the vapor phase product from the countercurrent reactor. The vapor phase product(s) may undergo further vapor phase hydroprocessing if greater reduction in heteroatom and aromatic species is desired or sent directly to a recovery system. The catalyst may be contained in one or more beds in one vessel or multiple vessels. Various hardware i.e. distributors, baffles, heat transfer devices may be required inside the vessel(s) to provide proper temperature control and contacting (hydraulic regime) between the liquid, vapors, and catalyst. Also, cascading and liquid or gas quenching may also be used in the practice of the present, all of which are well known to those having ordinary skill in the art.

In another embodiment of the present invention, the feedstock can be introduced into a first reaction zone co-current to the flow of hydrogen-containing treat-gas. The vapor phase effluent fraction is separated from the liquid phase effluent fraction between reaction zones; that is, in a non-reaction zone. This separation between reaction zones is also referred to as catalytic distillation. The vapor phase effluent can be passed to additional hydrotreating, or collected, or further fractionated and sent to an aromatics reformer for the production of aromatics. The liquid phase effluent will then be passed to the next downstream reaction zone, which will be a hydroisomerization zone operated in a countercurrent mode. In other embodiments of the present invention, vapor or liquid phase effluent and/or treat gas can be withdrawn or injected between any reaction zones.

The countercurrent contacting of an effluent stream from an upstream reaction zone, with hydrogen-containing treat gas, strips dissolved heteroatom impurities from the effluent stream, thereby improving both the hydrogen partial pressure and the catalyst performance. That is, the catalyst may be on-stream for substantially longer periods of time before regeneration is required. Further, higher heteroatom removal levels will be achieved by the process of the present invention.

The following examples are presented for illustrative purposes only and are not to be taken as limiting the present invention in any way.

EXAMPLE 1

A mixture of hydrogen and carbon monoxide synthesis gas ($H_2$:CO 2.11–2.16) was converted to heavy paraffins in a slurry Fischer-Tropsch reactor. A titania supported cobalt rhenium catalyst was utilized for the Fischer-Tropsch reaction. The reaction was conducted at about 217° to 220° C., 287–289 psig, and the feed was introduced at a linear velocity of 12 to 17.5 cm/sec. The kinetic alpha of the Fischer-Tropsch product was 0.92. The paraffinic Fischer-Tropsch product was isolated in three nominally different boiling streams; separated by utilizing a rough flash. The three boiling fractions which were obtained were: 1) $C_5$ to about 260° C., which is sometimes referred to as cold separator liquid, or light oil; 2) about 260° to 370° C. hot separator liquid; and 3) a 370° C.+ boiling fraction, i.e., a reactor wax.

EXAMPLE 2

Two catalysts were evaluated for hydroisomerization of Fischer-Tropsch light oil product produced in Example 1. All tests were conducted in a small upflow pilot plant unit at 1000 psig, 0.5 LHSV, with a hydrogen treat gas rate of 3000 SCFB, and at temperatures of 290° C. to about 400° C. Material balances were collected at a series of increasing temperatures with operation periods of 100 to 250 hours at each condition. The first catalyst contained 0.5 wt. % Pd on a composite support with 20 wt. % $Al_2O_3$ and 80 wt. % ultrastable-Y. The second catalyst contained 4 wt. % surface impregnated silica on a base catalyst with 0.7 wt. % Pd on an amorphous silica-alumina support containing 10 wt. % silica. Little or no conversion of this feed could be accomplished with either catalyst for reaction temperatures up to 400° C.

EXAMPLE 3

The same feed used in Example 2 was subjected to hydrotreating and fractionation before isomerization testes were conducted. Hydrotreating was carried out at 350 psig, 232° C., and 3 LHSV using a 50% $Ni/Al_2O_3$ catalyst. After hydrotreating, the feed was topped to an initial boiling point of about 175° C. prior to isomerization. The isomerization tests were carried out at 330–600 psig, about 290° to 400° C., and a 1.0 LHSV using a catalyst similar to one used in Example 2 above. This catalyst contained 0.30 wt. % palladium dispersed on a 10% $SiO_2$—$Al_2O_3$ support which was further modified by the addition of 6 wt. % surface silica derived from impregnation of $Si(OC_2H_5)_4$. In contrast to Example 2 above, the hydrotreated feed showed good reactivity for conversion. At high levels of 260° C.+ conversion, the 160° C. to 260° C. product was suitable for use as jet fuel without further blending. More specifically, the material had exceptional low temperature properties, significantly below the Jet A-1 freeze point specification of −47° C. These data are summarized in Table I below.

TABLE I

Hydroisomerization of Hydrotreated 160° to 260° C. Fischer-Tropsch Light Oil

| | | | Product Yields | | 60°/260° C. Jet |
|---|---|---|---|---|---|
| Catalyst | Temp. °C. | n-$C_{10}$ + Conv. | $C_1$/160° C. | 160/260° C. | Freeze |
| Pd/Si $SiO_2$—$Al_2O_3$ | 315 | 84.1 | 54.63 | 45.37 | −51 |

The above examples clearly demonstrate the need to hydrotreat Fischer-Tropsch light oil prior to hydroisomerization. This is due to relatively high levels of oxygenates in the light oil which poison the hydroisomerization catalyst.

What is claimed is:

1. A process for converting a predominantly paraffinic stream boiling in the range of about 40° C. to about 260° C. to jet fuel, which process comprises:

reacting said stream, which consists essentially of a Fisher-Tropsch reaction product stream, in at least one reaction zone wherein the product stream flows countercurrent to upflowing hydrogen-containing treat gas in the presence of a hydroisomerization catalysts under hydroisomerization conditions.

2. The process of claim 1 wherein there is provided at least one co-current hydrotreating zone followed by at least one countercurrent hydroisomerization zone.

3. The process of claim 1 wherein hydroisomerization conditions include temperatures from about 200° C. to about 450° C. and pressures from about 100 to 1500 psig.

4. The process of claim 1 wherein the hydroisomerization catalyst is comprised of one or more metals from Groups IB, VIB, and VIII of the Periodic Table of the Elements on a suitable support.

5. The process of claim 4 wherein the metal concentration ranges from about 0.05 wt. % to about 20 wt. % based on the total weight of the catalyst.

6. The process of claim 5 wherein the catalyst contains at least one Group VIII metal, and at least one Group IB or Group VIB metal.

7. The process of claim 6 wherein the Group VIII metal is palladium.

8. The process of claim 6 wherein the Group VIII metal is selected from nickel and cobalt or a mixture thereof, and the Group IB metal is copper.

9. The process of claim 9 wherein the metal concentration of the catalyst ranges from about 0.1 wt. % to about 10 wt. %.

10. The process of claim 1 wherein there are at least two reaction zones, an upstream hydroisomerization reaction zone followed by a downstream hydrodewaxing reaction zone which is operated in a countercurrent mode.

11. The process of claim 10 wherein the hydroisomerization conditions include temperatures from about 200° C. to about 450° C. and pressures from about 100 to 1500 psig; the hydroisomerization catalyst is comprised of one or more metals from Groups IB, VIB, and VIII of the Periodic Table of the Elements on a suitable support; and the metal concentration ranges from about 0.05 wt. % to about 20 wt. % based on the total weight of the catalyst.

12. The process of claim 11 wherein the feedstock is a Fischer-Tropsch reaction product.

13. The process of claim 1 wherein there are at least two reaction zones, an upstream hydrotreating reaction zone followed by a downstream hydroisomerization reaction zone which is operated in a countercurrent mode.

14. The process of claim 1 wherein there is at least one hydroisomerization zone operated in a co-current mode and at least one hydrodewaxing reaction zone operated in countercurrent mode.

15. The process of claim 1 wherein there is at least one co-current hydrotreating zone followed by at least one countercurrent hydroisomerization zones followed by at least one countercurrent hydrodewaxing zone.

* * * * *